US005428517A

United States Patent [19]

Behringer

[11] Patent Number: 5,428,517

[45] Date of Patent: Jun. 27, 1995

[54] FIELD OF ACTION LIGHT FOR MEDICAL, PARTICULARLY DENTAL PRACTICE

[75] Inventor: Wolfgang Behringer, Bensheim-Wilmshausen, Germany

[73] Assignee: Siemens Aktiengesellschaft, Munich, Germany

[21] Appl. No.: 238,804

[22] Filed: May 6, 1994

Related U.S. Application Data

[63] Continuation of Ser. No. 101,726, Aug. 4, 1993, abandoned.

[30] Foreign Application Priority Data

Aug. 11, 1992 [DE] Germany ..... 42 26 595.9

[51] Int. Cl.[6] ..... F21V 19/04; F21V 29/00

[52] U.S. Cl. ..... 362/264; 362/294; 362/373; 362/226; 362/804

[58] Field of Search ..... 362/294, 804, 373, 263, 362/264, 327, 226, 319

[56] References Cited

U.S. PATENT DOCUMENTS

| | | | |
|---|---|---|---|
| 1,602,289 | 10/1926 | Tanner | 362/319 |
| 3,703,635 | 11/1972 | Burkarth . | |
| 4,254,454 | 3/1981 | Hardin, Jr. . | |
| 4,254,455 | 3/1981 | Neal, Jr. | 362/804 |
| 4,533,984 | 8/1985 | Gatton | 362/188 |
| 4,951,178 | 8/1990 | Shirai et al. | 362/319 |
| 5,134,554 | 7/1992 | Donato et al. . | |

FOREIGN PATENT DOCUMENTS

| | | |
|---|---|---|
| 0396219 | 11/1990 | European Pat. Off. . |
| 1072776 | 9/1954 | France . |
| 1108909 | 1/1956 | France . |
| 2670271 | 6/1992 | France . |
| 8800561 | 3/1988 | Germany . |
| 3807584 | 9/1989 | Germany . |
| 90 13 302.1 | 1/1991 | Germany . |
| 2100403 | 12/1982 | United Kingdom . |
| 2123132 | 1/1984 | United Kingdom . |
| WO91/14131 | 9/1991 | WIPO . |

*Primary Examiner*—Ira S. Lazarus
*Assistant Examiner*—Sara Raab
*Attorney, Agent, or Firm*—Hill, Steadman & Simpson

[57] ABSTRACT

A field of action light allowing lamp replacement in the voltage-free condition of the socket without prior disconnection of the power supply. The base and the lamp form a structural unit that is held is easily detachable fashion in the housing of the light fixture, wherein the base is provided with electrical wiper contacts that interact such with corresponding cooperating contacts in the housing of the light fixture that a contacting of the electrical contacts automatically ensues upon introduction of the structural unit into the housing and a separation of the electrical contacts automatically ensues with the detachment of the structural unit from the housing. A mechanism for axially adjusting the position of the lamp with respect to the reflector is provided.

15 Claims, 3 Drawing Sheets

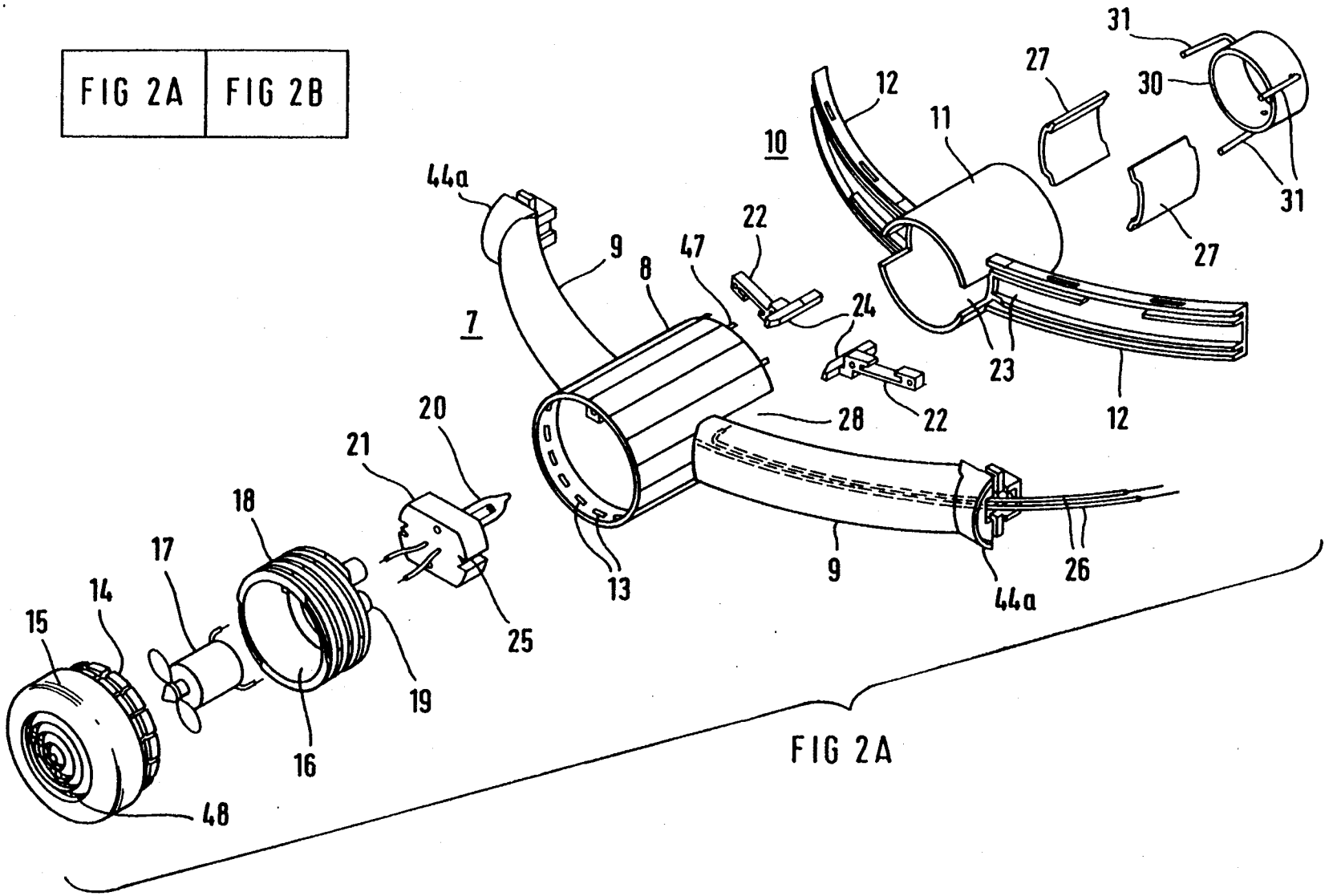
| FIG 2A | FIG 2B |
|---|---|

FIELD OF ACTION LIGHT FOR MEDICAL, PARTICULARLY DENTAL PRACTICE

This is a continuation of application Ser. No. 08/101,726, filed Aug. 4, 1993, now abandoned.

BACKGROUND OF THE INVENTION

The invention is directed to a field of action light that is particularly provided for dental practice.

Halogen lamps whose glass bulb, as known, should not be touched with the naked finger are currently mainly employed in field of action lights that are particularly utilized for dental practice.

In a known work place light, retaining and screening parts arranged at the front side must be removed for changing the lamp. The lamp situated in the inside of the housing of the light fixture is subsequently accessible, namely proceeding from the side of the glass bulb. In U.S. Pat. No. 4,254,454, the lamp is accessible proceeding from the back side of the light in that the reflector pivotally arranged at the housing of the light fixture is swivelled out for changing the lamp.

What the two designs have in common is that the voltage supply must be disconnected before changing the lamp or light bulb so that possible contact to voltage-carrying parts is precluded when replacing the lamp. The same is also true of another known design (German Utility Model 8 800 561) that discloses a socket for a two-pin halogen lamp. The base of the socket contains socket contacts, on the one hand, for the lamp pins and, on the other hand, fastening regions for holding the socket, for example at a housing. To this end, the base can be secured to current-conducting rails or "live" rails with screws that are screwed into rivets. For changing the lamp, it is pulled from the base socket. The lamp must thereby be necessarily grasped. The current or, respectively, voltage conduction up to the base remains in place, such that a replacement of the lamp can only ensue at zero voltage parts when, as in the prior art set forth above, the voltage supply is previously interrupted.

SUMMARY OF THE INVENTION

The object of the invention is to provide a field of action light with which it is possible to be able to replace the lamp in the voltage-free condition of the lamp socket without having to grasp the lamp with a hand and without having to previously disconnect the power supply, and with which it is possible to separate the lamp from the base without being impeded by reflectors or by the housing of the light fixture.

The design of the light is therefore to be implemented such that changing the lamp can be simply carried out with the standard protective measures for avoiding touching.

The base and the lamp are arranged in a housing and are connected to a structural unit that can be introduced into the housing of the light fixture proceeding from the front side and can be in turn mechanically separated therefrom. This structural unit contains means for the automatic electrical contacting in the form of wiper contacts that can be engaged and disengaged, allowing for simple and completely danger-free manipulation. The changing of the lamp always necessarily ensues at the power-free base without having to undertake special measures in advance in order to achieve this condition. The power-free condition is necessarily produced together with the mechanical separation of the structural unit from the housing of the light fixture.

The light advantageously provides a set-up means that comprises engagement means for the structural unit firmly connected to the base and also contains latch means for a releasable holding in an outer housing of the light, namely such that the base together with the lamp is axially movable when the set-up means is turned. An optimum focusing of the lamp with reference to the reflector can thus be achieved. The structural unit advantageously contains an electrically driven ventilator that is arranged in the housing that is the carrier of the base, whereby the voltage supply here also ensues via easily partible contacts.

Further advantageous developments derive from the following description of an exemplary embodiment of the invention.

BRIEF DESCRIPTION OF THE DRAWINGS

FIG. 2A is an exploded perspective view of a portion of the light of FIG. 1.

DETAILED DESCRIPTION OF THE PREFERRED EMBODIMENTS

Figure 1:
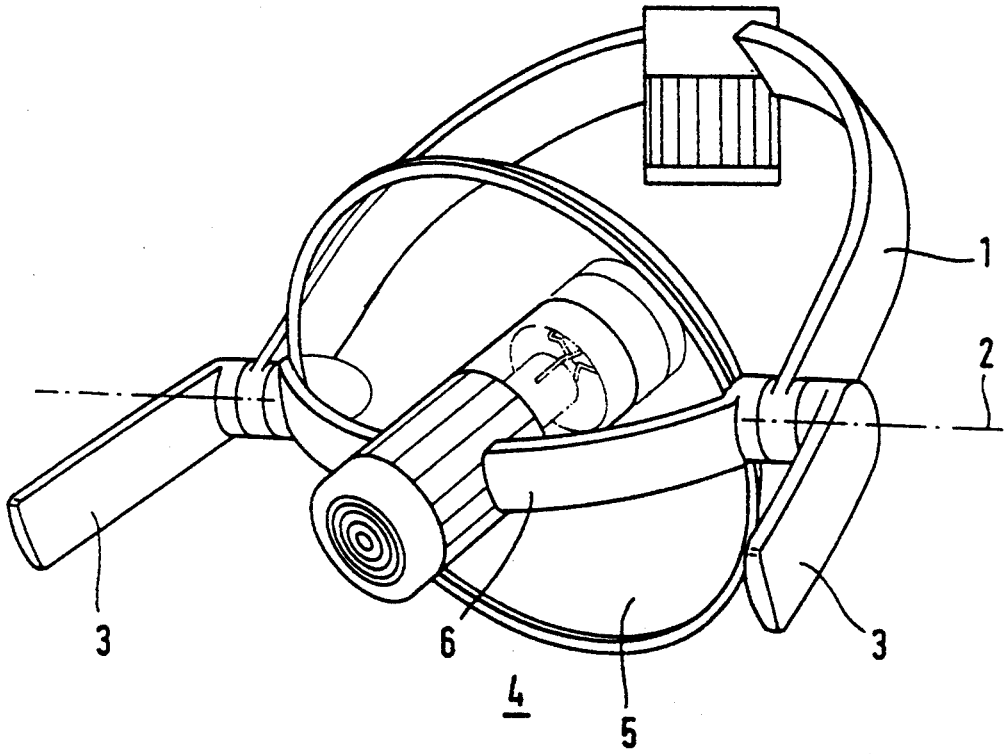
FIG. 1 a schematic perspective view of a dental field of action light.

FIG. 1 illustrates a dental field of action light having a carrying strap 1 that can be secured to a wall or ceiling bracket (not shown). A lamp assembly referenced 4 overall is swivelly arranged along a horizontal swivelling axis 2 and is swivelled with the assistance of laterally arranged grips 3. The lamp assembly 4 comprises a glass reflector 5 open toward the front, i.e. in illumination direction. The lamp assembly 4 is swivelly connected to the carrying strap 1 by a carrier part 6.

As may be seen from FIG. 2A, the reflector carrier part 6, fashioned bow-like, is composed of two halves, a front part 7 having a centrally arranged, cylindrical outside housing 8 and lateral arms 9 secured thereto at both sides, and of a rear part 10 which contains an inside housing 11 that fits into the outside housing 8 and having lateral arms 12 secured at both sides of housing 8 that partially engage into the lateral arms 9 of the front carrier part when the parts 7, 10 are joined.

The cylindrically fashioned outside housing 8 contains a plurality of tabs 13 at its circumference in the front end region thereof, these tabs 13 interacting with resilient elements 14 of a ventilator cap 15 and forming a snap-in connection that axially fixes the two parts when the ventilator cap 15 is installed.

A ventilator housing 16 accepts an electrically driveable ventilator 17 and whose outside circumference comprises a trapezoidal thread 18 that interacts with corresponding engagement means, such as threads, of the ventilator cap 15 that cannot be seen in the figure. The ventilator housing 16 is provided with fastening pins 19 to which a base 21 that accepts a lamp or bulb 20 can be secured.

In the assembled condition, the ventilator housing 16 together with the ventilator 17 and ventilator cap 15 form a structural unit with the lamp 20 and the base 21, this structural unit being arranged axially engageable in the outer housing 8 of the front carrier half 7 on the basis of the snap-in connection 13, 14 and being arranged easily releasable in axial direction for changing the lamp. The snap-in connection is designed such that the ventilator cap can be turned in the engaged condition. Given a rotation of the ventilator cap 15, the ventilator housing 16 and, thus, the base secured thereto can be axially displaced via the engagement with the trapezoidal thread 18, as a result whereof an optimum setting of the focus of the lamp with respect to the reflector can be achieved.

The electrical supply of the lamp 20 ensues via electrical wiper contact elements 22 that are held in recesses 23 arranged at both sides of the inner housing 11 and are also held in the lateral arms 12 of the rear carrier half 10. The wiper contact elements 22 are provided with contact rails 24 that correspond to resilient contact surfaces 25 in the base 21. The arrangement is undertaken such that a contacting is guaranteed given the abovedescribed longitudinal displaceability of the ventilator housing and, thus, of the base within the displacement path. The contact elements 22 are connected to the ends of electrical leads 26 that are laid in the hollow space of the one lateral arm formed by the two carrier halves and that are conducted into the carrying strap via pivot connections 44*a*. The electrical supply of the ventilator 17 can ensue via separate, further lines (not shown) that are likewise guided in one of the lateral arms and are brought to the ventilator 17 via clearances in the base 21.

Two cover plates are referenced 27, these, after the assembly of the two carrier halves 7 and 10, covering the recess 28 in the front carrier half 7 needed for the assembly. The outside housing 8 has its circumference completely closed as a result thereof.

A screen ring 30 is installed approximately in the region of the lamp helix in the assembled condition and serves, on the one hand, as a protection against heat and, on the other hand, for blanking scattered rays that arise in the region of the outside edge of the reflector. The screen ring 30 is secured axially displaceable with the assistance of retainer elements 31 in the inside housing 11 but is securely protected against twisting.

Figure 2B:
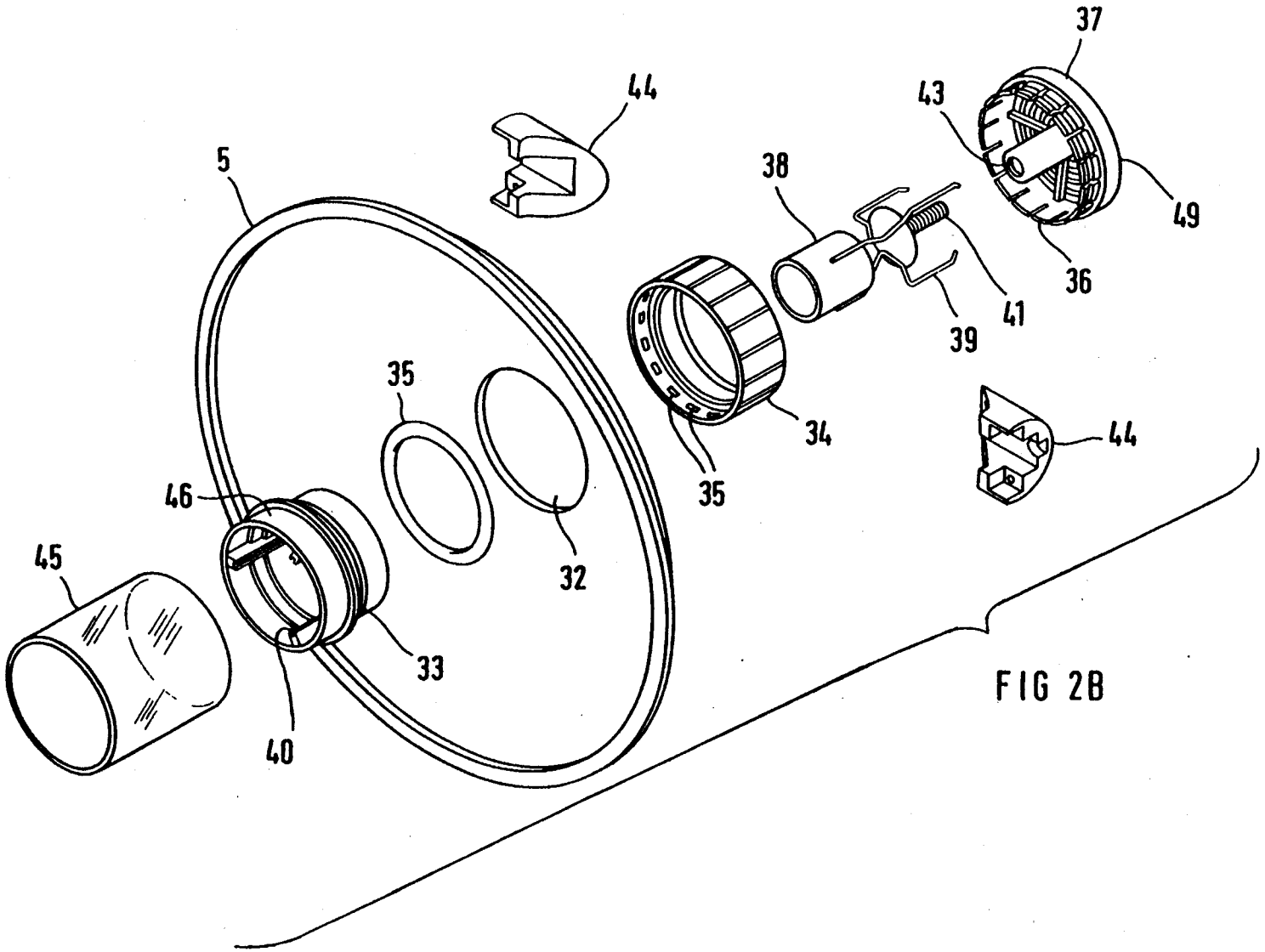
FIG. 2B is an exploded perspective view of a remaining portion of the light of FIG. 1.

It may be seen from FIG. 2B that the reflector 5 provided with a central bore 32 can be fixed by two parts 33, 34 connectable by screwing, upon interposition of a O-ring 35. The part 34 fashioned as a threaded ring contains a plurality of tabs 35 at its circumference that correspond with resilient elements 36 of an adjustment ring 37 and, in the assembled condition, form a snap-in connection that axially fixes the parts 34 and 37 that, however, can be turned relative to one another, similar to the components 15 and 8 (FIG. 2A). A screen 38 at least partially concentrically surrounds the lamp 20 in the assembled condition, this screen being carried by retainer elements 39 that are guided in longitudinally proceeding guide channels 40 in the retainer part 33 of the reflector. A threaded pin 41 that corresponds to a threaded nut 43 arranged at the adjustment ring 37 is secured to the retainer elements 39. In the assembled condition, i.e. when the parts 33 and 34 are screwed to one another and the adjustment ring 37 is snapped in place onto the threaded ring 34, the screen 38 can be longitudinally adjusted by turning the adjustment ring 37, as a result whereof the brightness of the light spot produced can be varied in a known way.

A cylindrical glass tube 45 is arranged between reflector 5 and the outside housing 8, the outside diameter of this glass tube 45 essentially corresponding to the outside diameter of the outside housing 8 and, facing toward the reflector, this glass tube 45 being put in place onto a correspondingly fashioned collar 46 of the retainer part 33 and being centered at the front carrier half 7 by guide tabs 47 correspondingly arranged at the circumference. The glass tube 45 is preferably composed of safety glass and is transmissive for visible light but is absorbent or, respectively, reflective for radiation lying in the infrared range. To this end, the tube can either be fabricated of an appropriate material or can also be provided with an appropriate coating.

It derives from the design set forth above that the heat-producing lamp 20 that can preferably be a halogen lamp, is practically shielded against uncontrolled emission of heat—with the exception of entry openings 48 at the face side of the ventilator cap 15 and exit openings 49 at the face side of the adjustment ring 37. The cylindrical parts 45 and 8 that serve as screening and proceed parallel to the axis of the rotationally symmetrical axis of the reflector form a designational heat-guiding means which effects that air can only proceed into the system at the front face of the lamp, i.e. at the ventilator cap 15 and can also emerge therefrom at the opposite side, i.e. at the face end of the adjustment ring 37. A certain chimney effect arises with this heat-guiding system and this can be intensified by turning the ventilator 17 on as warranted, i.e. when the lamp is in use for a longer time.

As already addressed, the replacement of the lamp or light bulb is possible in a very easy way, in that the described structural unit composed of the parts 14 through 21 is axially pulled from the housing 8, whereby a particular advantage is comprised therein that the lamp is voltage-free after the removal of the structural unit, as a result whereof no additional safety measures such as turning the light off at the primary side are required. A further important advantage may be seen therein that —when the glass tube 45 is a safety glass—no additional safety measures need be undertaken which would basically have to be undertaken given halogen lamps because of the relatively high inside pressure ($\geqq 10$ bar), for which purpose an additional anti-explosion means is provided in lights of the prior art.

Although the present invention has been described with reference to a specific embodiment, those of skill in the art will recognize that changes may be made thereto without departing from the scope and spirit of the invention as set forth in the appended claims.

I claim as my invention:

1. For a field of action light, having a base holding a lamp within a fixture housing, the improvement comprising:

a structural unit that can be introduced into a front opening of the fixture housing proceeding from a front side and can be held in latching fashion thereat, the structural unit including the base and the lamp, wherein the base is provided with electrical wiper contacts adapted to interact with corresponding cooperating contacts in the fixture housing that an electrical connection automatically ensues when the structural unit is introduced into the fixture housing and a separation of the electrical connection automatically ensues with the removal of the structural unit; and wherein the fixture comprises two lateral front arms secured to the fixture housing to form a front carrier half and an inside housing introducible into the fixture housing and two lateral back arms secured to said inside housing form a back carrier half, wherein the respective lateral front and back arms are fashioned such that they partially engage into one another in the assembled condition and thereby form a hollow space for guiding electrical lines.

2. The improvement according to claim 1, whereby the structural unit comprises axial adjustment means for the base such that the base together with the lamp is axially displaced given a rotation of the axial adjustment means.

3. The improvement according to claim 1, wherein said structural unit includes a ventilator housing holding an electrically driveable ventilator.

4. For a field of action light, having a base holding a lamp within a fixture housing, the improvement comprising:

a structural unit that can be introduced into a front opening of the fixture housing proceeding from a front Side and can be held in latching fashion thereat, the structural unit including the base and the lamp, wherein the base is provided with electrical wiper contacts adapted to interact with corresponding cooperating contacts in the fixture housing that an electrical connection automatically ensues when the structural unit is introduced into the fixture housing and a separation of the electrical connection automatically ensues with the removal of the structural unit;

wherein said structural unit includes a ventilator housing holding an electrically driveable ventilator; and whereby the structural unit comprises axial adjustment means for the base such that the base together with the lamp is axially displaced given a rotation of the axial adjustment means, wherein the axial adjustment means comprises an outside thread on said ventilator housing and an adjustment element being arranged at a ventilator cap that contains air entry openings, said adjustment element engageable with said outside thread, and wherein the fixture housing of the light fixture and the ventilator cap are provided with catch means that hold the ventilator cap rotatably and axially engageable such that the ventilator housing together with the base are adjusted in axial direction when the ventilator cap is turned.

5. The improvement according to claim 4, comprising a carrying strap for mounting the light to a structure and wherein the fixture housing is provided with lateral arms proceeding transversely relative to a longitudinal axis, and retainer means for a pivotally holding the fixture housing connecting the carrying strap to the ends of said lateral arms.

6. The improvement according to claim 5, wherein the lateral arms are fashioned bow-shaped.

7. The improvement according to claim 4, wherein the fixture housing extends forwardly from a front surface of a reflector of the light, and the fixture housing having a non-transparent section, a transparent section and a reflector mounting section, and a screen for surrounding the lamp, wherein the reflector is provided with a central bore at which said reflector is grasped by the reflector mounting section which has a front mount part having a collar onto which the one end of the transparent section of the fixture housing is retained, the other end of the transparent section being connectable to the non-transparent section; and a back mount part having adjustment means for axially adjusting the screen that surrounds the lamp, with the assistance of which screen the light rays partially for the purpose of varying the brightness of the field of illumination.

8. A field of action light, comprising:

a concave reflector;

an elongate housing proceeding from an inside surface of said reflector forwardly;

a lamp;

a lamp base assembly holding said lamp, and having electric conduction means for conducting the lamp terminals to a pair of electrical wiper contacts arranged on said base assembly;

corresponding wiper contacts mounted within said elongate housing and arranged and adapted to engage said electrical wiper contacts when said base assembly is installed into said housing;

said base assembly and said lamp installed into said housing; and means for selectively axially positioning said base assembly and said lamp within said housing with respect to said reflector, said housing having a transparent section in the region of said lamp to pass light from said lamp to said reflector; and wherein said means for selectively axially positioning comprises adjustment threads on said base assembly and a cap covering a front open end of said housing, said cap having companion threads to said adjustment threads and engaged therewith, axial rotation of said cap axially positioning said base assembly and said lamp within said housing.

9. The he field of action light according to claim 8, wherein said base assembly comprises at a forward end thereof, a tubular ventilator housing;

and said cap comprises air inlet openings therethrough; and said field of action light further comprises a ventilator fan mounted within said ventilator housing for drawing air through said air inlet openings; and said housing further provides air exit openings at an opposite end of said housing as said open end.

10. The field of action light according to claim 9, wherein said reflector comprises a central bore and said elongate housing passes through said central bore, said elongate housing comprising screwed collar means for clamping said reflector to said housing at an intermediate position of said housing; and said air exit openings are arranged through said elongate housing on a back side of said reflector.

11. The field of action light according to claim 8, comprising a carrying strap for mounting the light to a structure and wherein the housing of the light is provided with lateral arms proceeding transversely relative to the longitudinal axis, and retainer means for a pivotally holding the fixture housing connecting the carrying strap to the ends of said lateral arms.

12. A field of action light, comprising:

a concave reflector;

an elongate housing proceeding from an inside surface of said reflector forwardly;

a lamp;

a lamp base assembly holding said lamp, and having electric conduction means for Conducting the lamp terminals to a pair of electrical wiper contacts arranged on said base assembly;

corresponding wiper contacts mounted within said elongate housing and arranged and adapted to engage said electrical wiper contacts when said base assembly is installed into said housing;

said base assembly and said lamp installed into said housing; and means for selectively axially positioning said base assembly and said lamp within said housing with respect to said reflector, said housing having a transparent section in the region of said lamp to pass light from said lamp to said reflector; and wherein the fixture comprises two lateral front arms secured to the housing to form a front carrier half and an inside housing introducible into the housing of the light fixture and two lateral back arms secured to said inside housing forming a back carrier half, wherein the respective lateral front and back arms are fashioned such that they partially engage into one another in the assembled condition and thereby form a hollow space for guiding electrical lines.

13. For a field of action light, having a base holding a lamp within a fixture housing, the improvement comprising:

a structural unit that can be introduced into a front opening of the fixture housing proceeding from a front side and can be held in latching fashion thereat, the structural unit including the base and the lamp, wherein the base is provided with electrical wiper contacts adapted to interact with corresponding cooperating contacts in the fixture housing that an electrical connection automatically ensues when the structural unit is introduced into the fixture housing and a separation of the electrical connection automatically ensues with the removal of the structural unit; and wherein at least one member of each pair of said electrical wiper contact and said corresponding cooperating contact is elongate in an axial direction and said structural unit is axially adjustable in position within said fixture housing, said wiper contacts and said corresponding cooperating contacts assuring electric contact throughout a range of axial adjustment of said structural unit within said fixture housing.

14. The improvement according to claim 13, wherein said structural unit comprises axial adjustment means for the base such that the base together with the lamp is axially displaceable by rotating the axial adjustment means.

15. The improvement according to claim 14, wherein said structural unit includes a ventilator housing and wherein said axial adjustment means comprises an outside thread on said ventilator housing and an adjustment element being arranged at a ventilator cap that contains air entry openings, said adjustment element engageable to said outside thread and wherein the fixture housing and the ventilator cap are provided with catch means that hold the ventilator cap rotatably and axially engageable such that the ventilator housing together with the base are adjusted in axial direction when the ventilator cap is turned.

* * * * *